United States Patent [19]

Shimada et al.

[11] 4,334,127

[45] Jun. 8, 1982

[54] MAGNETIC CIRCUIT FOR PLANAR DIAPHRAGM TYPE LOUDSPEAKER

[75] Inventors: Kunihiko Shimada; Yukio Tsuchiya, both of Tokorozawa, Japan

[73] Assignee: Pioneer Electronic Corporation, Tokyo, Japan

[21] Appl. No.: 164,128

[22] Filed: Jun. 30, 1980

[30] Foreign Application Priority Data

| | | | |
|---|---|---|---|
| Jun. 30, 1979 | [JP] | Japan | 54-82956 |
| Jun. 30, 1979 | [JP] | Japan | 54-82957 |
| Jun. 30, 1979 | [JP] | Japan | 54-90270[U] |
| Jun. 30, 1979 | [JP] | Japan | 54-90275[U] |

[51] Int. Cl.[3] ..... H04R 9/02

[52] U.S. Cl. ..... 179/115.5 R; 179/117; 335/306

[58] Field of Search ..... 335/296, 306; 179/115.5 R, 117, 119 R, 120, 115.5 PV, 180, 115.5 VC

[56] References Cited

U.S. PATENT DOCUMENTS

| | | | |
|---|---|---|---|
| 1,743,011 | 1/1930 | Zimmerman | 179/119 R |
| 3,937,905 | 2/1976 | Manger | 179/115.5 R |
| 3,979,566 | 9/1976 | Willy | 179/115.5 VC |
| 4,013,846 | 3/1977 | Krawczak et al. | 179/115.5 R |

*Primary Examiner*—George G. Stellar

*Attorney, Agent, or Firm*—Sughrue, Mion, Zinn, Macpeak and Seas

[57] ABSTRACT

A magnetic circuit for a planar diaphragm type loudspeaker having a square planar diaphragm and square voice coil in which four magnetic circuits are arranged in a square corresponding to the edges of the planar diaphragm. Pairs of plates are disposed opposite to one another upon which are attached a number of magnets with the opposed poles opposite one another along the inner walls of the oppositely disposed plates. Each of the magnets is rectangular in shape. A yoke connects the pairs of plates. Holes for permitting air flow are formed either in the yoke or in the pairs of oppositely disposed plates in patterns such as to not disturb the magnetic field. The magnetic circuit units made up by the magnets, pairs of plates, and yokes are joined at their ends by magnetic couplings. An electrical conductive member may be disposed over portions of the magnets to prevent the occurrence of third harmonic distortion due to current distribution.

12 Claims, 20 Drawing Figures

MAGNETIC CIRCUIT FOR PLANAR DIAPHRAGM TYPE LOUDSPEAKER

BACKGROUND OF THE INVENTION

The present invention relates to magnetic circuits and more particularly to a magnetic circuit suitable as the driver unit of a planar diaphragm type loudspeaker.

It is known in the art that a planar diaphragm loudspeaker has a relatively flat acoustic pressure characteristic throughout its frequency range and accordingly can reproduce sounds with stable acoustic images. A variety of loudspeakers employing such planar diaphragms have been proposed in the art. Since planar diaphragm type loudspeaker systems of relatively large diameter can be readily manufactured, planar diaphragms are suitable for manufacturing high power loudspeaker systems.

However, employment of a large diameter diaphragm involves problems such as the provision, at a low manufacturing cost, of a driver unit which can sufficiently operate a large diaphragm. More specifically, since a large diameter bass-range diaphragm needs a large driver unit, it has proven rather difficult to assemble such a driver unit. For instance, large magnetic circuits require large plates and magnets. For a square planar diaphragm, a large, frame-shaped magnetic circuit is required. Such a large magnetic circuit is intricate in construction. Accordingly, it is difficult to assemble and process such a large magnetic circuit.

In a conventional linear type magnetic circuit, the magnetic flux from the magnet is introduced through the plate to the field system. That is, the conventional linear type magnetic circuit employs a circular external magnet type magnetic circuit. Accordingly, its magnetic flux leakage coefficient and electromotive force loss are undesirably high and its efficiency is low.

SUMMARY OF THE INVENTION

Accordingly, in order to overcome these difficulties, an object of the invention is to provide a linear type magnetic circuit having a high efficiency and which is arranged along a square voice coil of a square planar diaphragm type loudspeaker.

The foregoing object and other objects of the invention have been achieved by the provision of a linear type magnetic circuit in which plural magnetic circuit units are arranged in the form of a polygon, such as for instance a square, and are mechanically and magnetically connected to one another with gaps at the corners of the polygon. Each of the magnetic circuit units has a number of small magnet units instead of a single large, linear type magnet. The small magnetic units are arranged linearly so as to have the same effect as that of the large linear type magnet.

The nature, principle and utility of the invention will become more apparent from the following detailed description when read in conjunction with the accompanying drawings.

BRIEF DESCRIPTION OF THE DRAWINGS

In the accompanying drawings:

FIG. 14(*b*) is a sectional view taken along line XIV—XIV in FIG. 14(*a*);

DESCRIPTION OF THE PREFERRED EMBODIMENTS

Preferred examples of a magnetic circuit for planar diaphragm type loudspeakers according to the invention will be described with reference to the accompanying drawings.

Figure 1:
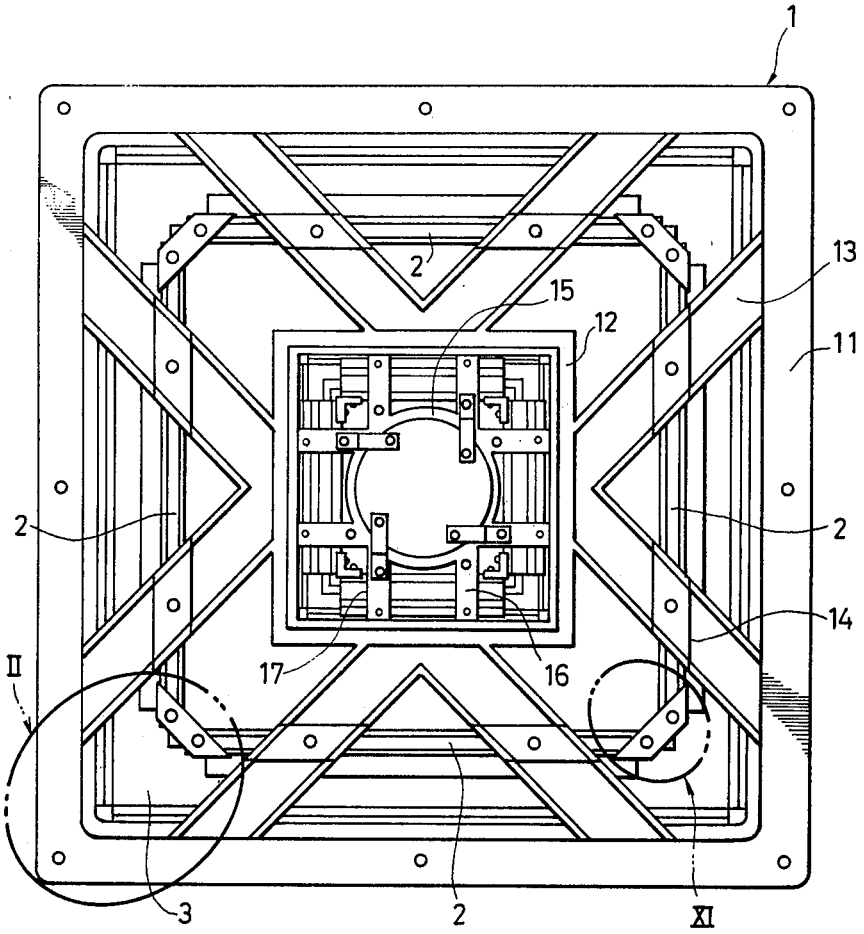
FIG. 1 is a rear view of a planar diaphragm type loudspeaker.
Figure 2:
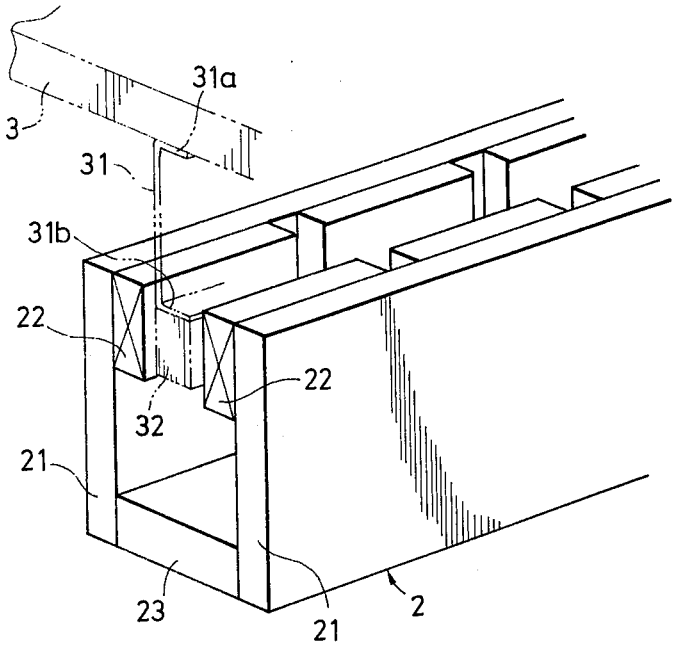
FIG. 2 is a perspective view of a part II designated in FIG. 1 showing an example of a magnetic circuit constructed according to the invention.
Figure 3:
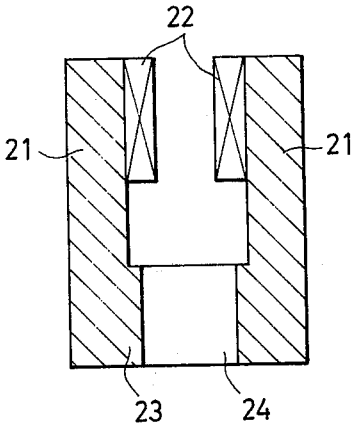
FIGS. 3 and 4 are sectional views showing second and third examples of magnetic circuits according to the invention.
Figure 4:
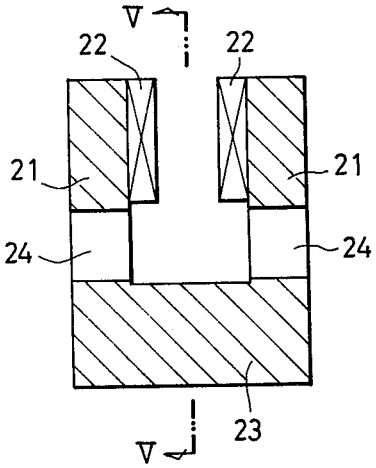

FIG. 1 is a rear view of a loudspeaker unit employing a square planar diaphragm and constructed with a first preferred embodiment of a magnetic circuit of the invention and FIG. 2 is a perspective view of a portion II thereof. Referring first to FIG. 2, the loudspeaker unit has a voice coil bobbin 31 whose opposite end portions are bent at 90 degree angles with respect to the body of the voice coil bobbin 31 forming flanges 31*a* and 31*b* which are parallel to the sides of the square planar diaphragm 3. The flange 31*a* is secured to the diaphragm 3. A square voice coil 32 is coupled to the rear side of the flange 31*b* and is positioned in the air gap of the magnetic circuit 2. In this connection, it should be noted that the magnetic circuit 2 is made up of a plurality of magnetic circuit units, which are also designated by reference numeral 2, as will become more apparent from the discussion which follows.

The magnetic circuit unit 2 may be provided with a single magnet assembly constituted by large magnets of different polarity arranged linearly confronting one another. However, in the case of a large bass-range driver unit, the magnet assembly is necessarily bulky. Accordingly, its manufacturing cost is high since it is necessary to construct it with a high precision, and in addition it is rather difficult to magnetize such a large magnet assembly. Moreover, if a large magnet assembly were used, it is subject to breakage during storage because of the weight and magnetic force of the magnet.

In order to overcome these difficulties according to the invention, as shown in FIG. 2, a pair of elongated plates 21 are disposed opposite each other and a number of small magnet units 22 are arranged along the edge portions of the plates 21 with different polarity units disposed opposite one another. The opposite edge portions of the plates 21 are coupled through a yoke 23 to form a rigid unit. However, the unit constituted by the plates 21 and the yoke 23 may be replaced by a single member having a U-shape in section.

Since the saturated magnetic flux density of the magnet assembly depends upon the material of the plates 21, the sectional area of the plates 21 should be determined in accordance with the material of the plates 21.

With the magnetic circuit formed as described above, unless the gap in the field system is overly increased, the theoretical magnetic flux leakage coefficient is unity and hence the magnetic flux density at the magnet operating point is equal to the magnetic flux density of the field system whereby a magnetic circuit having a very high efficiency is provided.

In the above-described embodiment, the magnetic circuit units can be readily assembled together with high accuracy as they are constructed as unified components. Because they are of simple configuration, the plates can be formed by stamping at low manufacturing cost.

Second and third examples of a magnetic circuit unit 2 of the invention are shown in FIGS. 3 through 6. As is clear from FIGS. 3 through 6, the magnetic circuits 2 are of the internal magnet type. In FIGS. 3 through 6, those components which have been previously described with reference to FIGS. 1 and 2 are similarly numbered.

The second and third examples are intended to eliminate a difficulty in that the flow of air produced by the piston motion of the diaphragm 3 and the motion of the voice coil 32 adversely affects the field system. The air in the space behind the diaphragm 3 and the voice coil 32 is compressed and expanded by the movement of the diaphragm 3 and the voice coil. These movements are disturbed by the viscous resistance of the air as a result of which characteristic distortion is sometimes caused. In order to overcome this difficulty, the second and third embodiments have been developed.

A plurality of air holes 24 of suitable size and configuration are formed in the plates 21 or the yoke 23. The dimensions and positions of the holes are chosen such that their presence does not make the magnetic flux patterns irregular. The air holes 24 can be formed in either or both of the plates 21 and the yoke 23.

Figure 5:
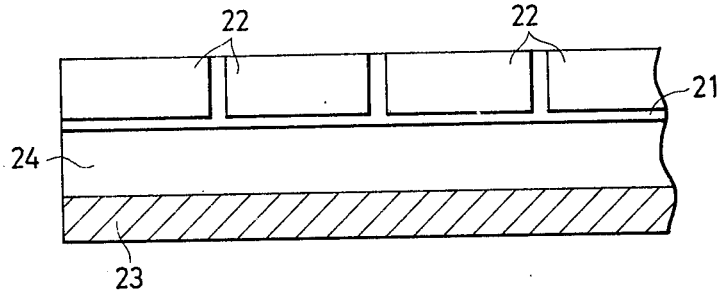
FIG. 5 is a sectional view taken along line V—V in FIG. 4.
Figure 6:
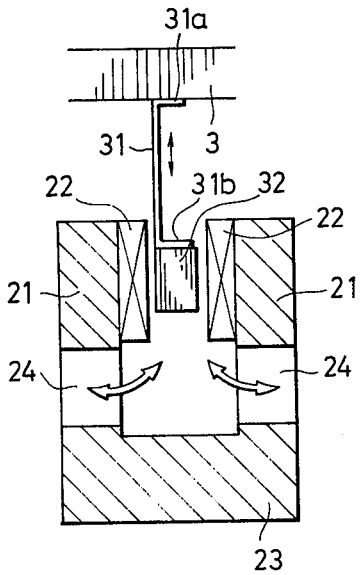
FIG. 6 is a sectional view, similar to that of FIG. 4, showing the flow of air which is caused by the piston motion of the diaphragm according to the invention.

As a result of the provision of the air holes 24, the flow of air produced by the piston motion of the diaphragm 3 is relieved from the narrow space in the field system as shown in FIG. 5. Moreover, a cooling effect is produced by the flow of air. If it is desired to increase the cooling effect, then the air holes 24 should be formed confronting each other. If no air holes were provided, as the voice coil moved, air would be sucked into and discharged from the region of the magnetic circuit thus generating frictional noises. However, the generation of such noises is eliminated because the interior of the magnetic circuit is effectively opened to the atmosphere through the air holes.

Figure 7:
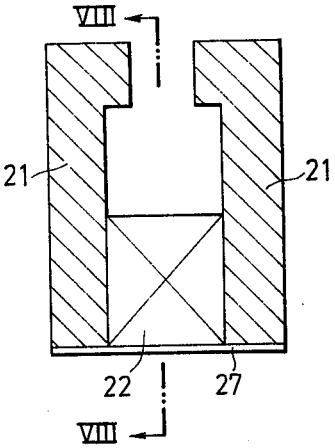
FIG. 7 is a sectional view showing a fourth example of a magnetic circuit according to the invention.
Figure 8:
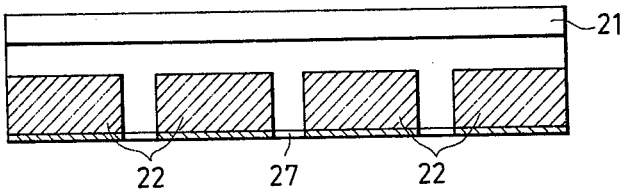
FIG. 8 is a sectional view taken along line VIII—VIII in FIG. 7.

FIGS. 7 and 8 show a fourth embodiment of the magnetic circuit unit 2 which is an external magnet type of a magnetic circuit unit. In this case, one surface of each magnet unit 22 is exposed and therefore it is desirable that a protective film 27 be bonded to the outer surface of the magnetic circuit.

Figure 9:
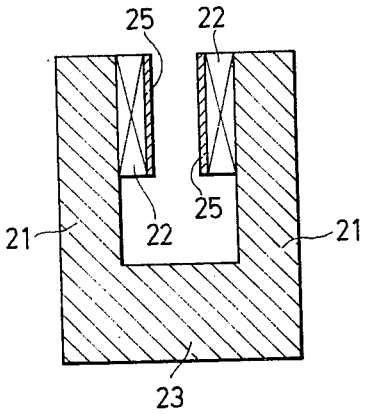
FIGS. 9 and 10 are sectional views showing a fifth example of the magnetic circuit according to the invention in which harmonic distortion is minimized.
Figure 10:
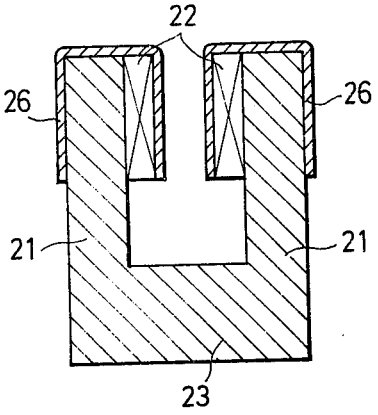

Fifth and sixth embodiments of an internal magnet type magnetic circuit unit 2 of the invention are shown in FIGS. 9 and 10, respectively. In these two embodiments, provision is made for reducing third harmonic distortion due to current distortion. More specifically, in the magnetic circuit in FIG. 9, electrically conductive sheets 25 made of copper or aluminum are bonded to the opposed surfaces of the magnet units 22. The electrically conductive sheets 25 may be applied to one or both of the opposed surfaces. In the magnetic circuit in FIG. 10, caps 26 of electrically conductive material such as copper or aluminum are disposed over the end portions of the plates 21 and the magnet units 22.

Figure 11:
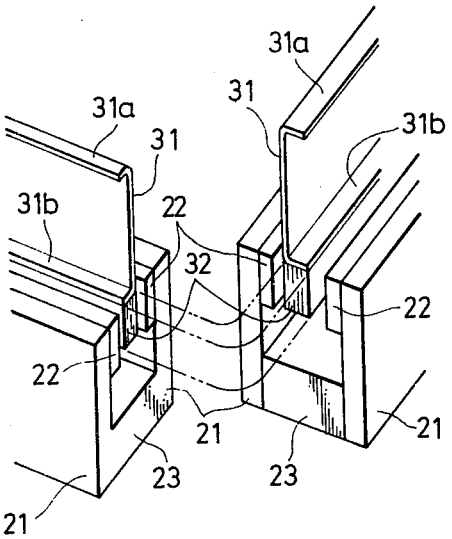
FIG. 11 is a perspective view, at enlarged scale, showing a part XI designated in FIG. 1.
Figure 12A:
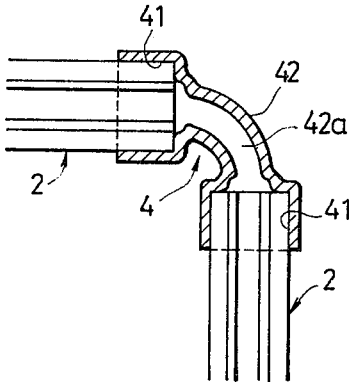
FIGS. 12(*a*) and 12(*b*) are a plan view and a side view respectively, showing a first example of a connector adapted to connect adjacent magnetic circuit units of a magnetic circuit according to the invention.
Figure 12B:
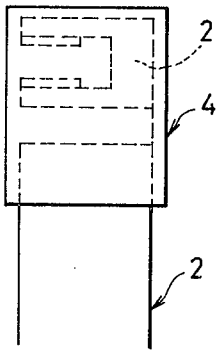

The above-described magnetic circuit units 2 are arranged in such a manner that adjacent units 2 are at 90° angles as shown in FIG. 11 and are mechanically and magnetically connected with connectors 4 as shown in FIGS. 12(*a*), 12(*b*), 13, 14(*a*), 14(*b*), 15(*a*) and 15(*b*).

The connector 4 shown in FIGS. 12(*a*) and 12(*b*) is made of magnetic metal and has insertion recess portions 41 at both ends and a coupling portion 42 through which the insertion recess portions are coupled to each other. One end portion of the magnetic circuit unit 2 is inserted into the insertion recess portion 41. The coupling portion 42, which is bent in conformance with the angle formed by adjacent magnetic circuit units 2, has a hollow part 42*a* communicating with the air gaps in adjacent magnetic circuit units 2 connected thereto. A corner portion of the voice coil 32 is accommodated in the hollow part 42*a* of the coupling portion 42 so that the leakage magnetic flux of the magnets 22 is introduced into the hollow part 42*a* as a result of which the effective length of the voice coil is increased.

Figure 13:
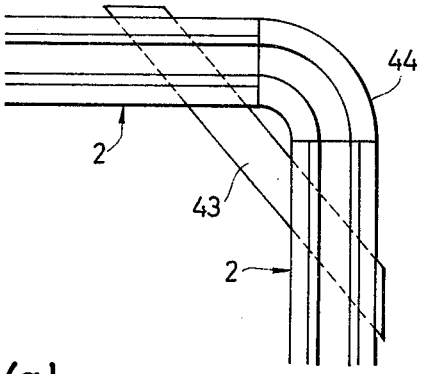
FIG. 13 is a plan view of a second example of the connector.

The connector 4 shown in FIG. 13 is made up of a mechanical connecting member and a magnetic connecting member. More specifically, the connector 4 includes a mechanical connecting member 43 which is positioned obliquely with respect to the end portions of adjacent magnetic circuit units 2 which are arranged at right angles, and also includes an elbow type connecting member the ends of which are in close contact with the end faces of the adjacent magnetic circuit units 2, thus magnetically connecting the magnetic circuit units 2. It should be noted that the connecting member additionally performs a heat radiating function cooling the corresponding corner portions of the voice coil 32 which does not extend into the air gap between the opposed magnets 22. The mechanical connecting member 43 may be made of magnetic material. However, it should be connected so that it does not short any of the magnets 22.

Figure 14A:
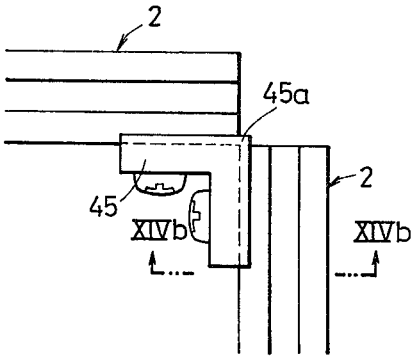
FIG. 14(*a*) is a plan view of a third example of the connector.
Figure 14B:
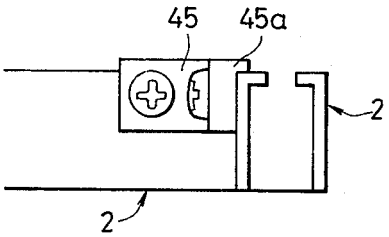

The connector 4 shown in FIGS. 14(*a*) and 14(*b*) is an L-shaped metal member 45 which is secured to the inner walls of adjacent magnetic circuit units 2 with screws. The connector has a flange 45*a* which is placed in contact with the upper edges of the magnetic circuit units 2 which are of the internal magnet type as shown in FIGS. 7 and 8.

Figure 15A:
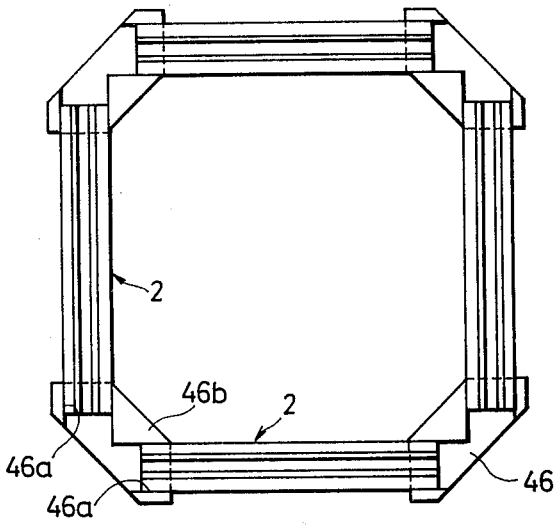
FIGS. 15(*a*) and 15(*b*) are a plan view and a side view, respectively, showing a fourth example of the connector.
Figure 15B:
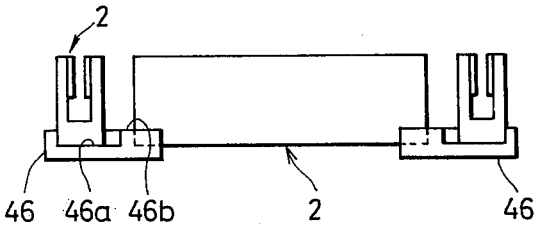

The connector 4 shown in FIGS. 15(*a*) and 15(*b*) has two grooves 46*a* which are perpendicular to each other and which are adapted to receive the end portions of adjacent magnetic circuit units 2 and a guide 46*b* used for positioning the inner walls of adjacent magnetic circuit units 22 at the respective corners. Thus, using four such connectors, four magnetic circuit units 2 arranged in a square can be accurately positioned relative to one another and rigidly connected to one another. The connector 4 is preferably made of magnetic material.

Figure 16:
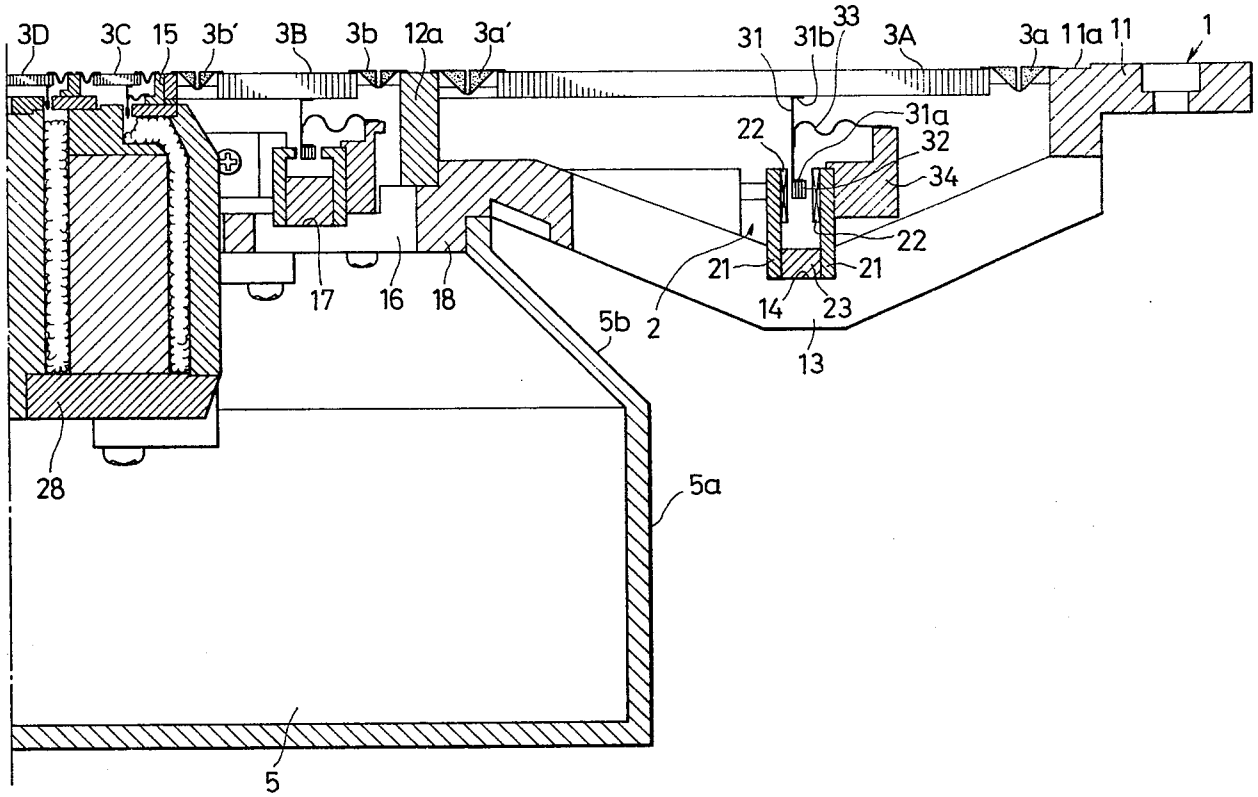
FIG. 16 is a sectional view showing an example of a loudspeaker system employing the magnetic circuits according to the invention.
Figure 17:
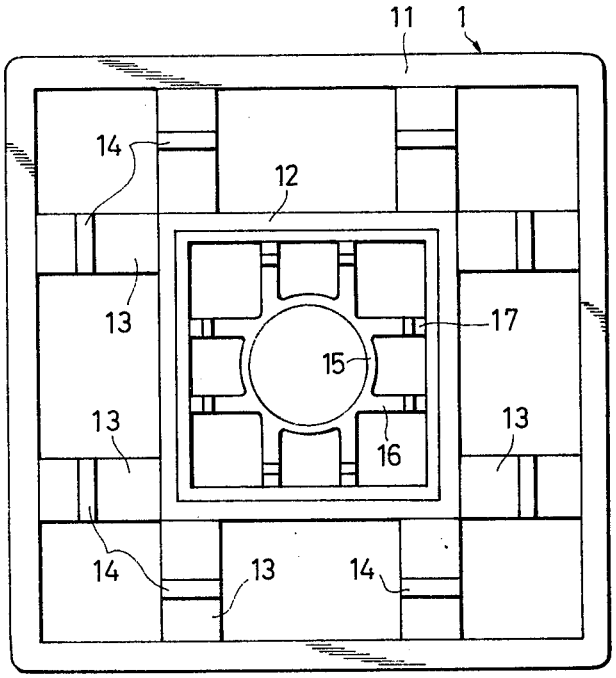
FIG. 17 is a plan view showing another example of a planar diaphragm type loudspeaker of the invention.

An example of a 4-way planar diaphragm type loudspeaker employing a magnetic circuit of the invention is shown in FIG. 16. A plan view of this loudspeaker from the rear side is shown in FIG. 17. The loudspeaker includes a bass-range diaphragm 3A, a mid-range diaphragm 3B, a treble-range diaphragm 3C, and a super-treble-range diaphragm 3D. In FIG. 16, reference numeral 14 designates a groove formed in a connection arm 13 used to position the above-described magnetic circuit unit 2, 17 a groove which is formed in a coupling arm 16 and which is used to position a mid-range magnetic circuit unit 2'. The coupling arm 16 provided between an inner frame 12 and a central frame 15 supports the inner edge portion of the mid-range diaphragm 3B and extends perpendicularly to the respective sides of the inner frame 12. Reference numeral 33 designates a damper and 34 a damper base supporting the damper 33.

As is clear from the above description, the connection arms 13 forming the frame assembly of the loudspeaker are provided with grooves 14 into which the magnetic circuit units 2 are fitted so that the magnetic circuit units 2 can be mounted so as to leave accurate air gaps with respect to the voice coil 32. With this construction, the driving force of the voice coil is positively transmitted to the entire surface of the diaphragm.

FIG. 16 shows connection arms 13 which extend in the form of the character "V" to the outer frame 11 of the loudspeaker. However, it should be noted that the technical concept of the invention is applicable to connection arms which have the form of parallel crosses as shown in FIG. 1.

As is apparent from the above description, according to the invention, the magnetic circuit of the loudspeaker is formed with a plurality of straight magnetic circuit units each having a number of small magnets and air flowing holes. The straight magnetic circuit units are mechanically and magnetically connected to one another at the corners or ends thereof to form a complete magnetic circuit as a result of which the effective length of the voice coil is increased and the driving force at the corners of the square voice coil can be effectively utilized. Thus, a small magnetic circuit of high efficiency and which is simple to manufacture and maintain is provided with the invention. Since the straight magnetic circuit units are connected at the corners, they can easily be assembled and there is no problem that dust such as iron powder may stick to the magnet in the magnetic circuit.

What is claimed is:

1. A magnetic circuit comprising: a plurality of straight magnetic circuit units of a predetermined length, said magnetic circuit units being arranged in a polygon; and means for mechanically and magnetically coupling said magnetic circuit units at ends thereof, said means for mechanically and magnetically coupling said magnetic circuit units comprising an elbow section of magnetic metal, said elbow section having insert recess portions at both ends thereof and a curved coupling portion therebetween, said insert recess portions being adapted to receive ends of said magnetic circuit units.

2. A magnetic circuit comprising: a plurality of straight magnetic circuit units of a predetermined length, said magnetic circuit units being arranged in a polygon; and means for mechanically and magnetically coupling said magnetic circuit units at ends thereof, said means for mechanically and magnetically coupling said magnetic circuit units comprising a magnetic coupling member and a mechanical coupling member, said mechanical coupling member being positioned obliquely with respect to end portions of adjacent magnetic circuit units and said magnetic connecting member comprising an elbow-shaped section of magnetic metal.

3. A magnetic circuit comprising: a plurality of straight magnetic circuit units of a predetermined length, said magnetic circuit units being arranged in a polygon; and means for mechanically and magnetically coupling said magnetic circuit units at ends thereof, said means for mechanically and magnetically coupling said magnetic circuit units comprising an L-shaped metal member secured to inner walls of adjacent magnetic circuit units by screws, said member having a flange in contact with upper edges of adjacent magnetic circuit units.

4. A magnetic circuit comprising: a plurality of straight magnetic circuit units of a predetermined length, said magnetic circuit units being arranged in a polygon; and means for mechanically and magnetically coupling said magnetic circuit units at ends thereof, said means for mechanically and magnetically coupling said magnetic circuit units comprising a plate of magnetic metal having first and second perpendicular grooves formed in one surface thereof, said grooves being adapted to receive end portions of adjacent magnetic circuit units.

5. A magnetic circuit for a planar diaphragm type loudspeaker having a square planar diaphragm and a square voice coil corresponding to said square planar diaphragm, comprising:

four magnetic circuit units which are arranged along the four sides of said square planar diaphragm; and means for mechanically and magnetically coupling said magnetic circuit units to one another at junctions between adjacent ones of said magnetic circuit units, said means for mechanically and magnetically coupling said magnetic circuit units comprising an elbow section of magnetic metal, said elbow section having insert recess portions at both ends thereof and a curved coupling portion therebetween, said insert recess portions being adapted to receive ends of said magnetic circuit units.

6. A magnetic circuit for a planar diaphragm type loudspeaker having a square planar diaphragm and a square voice coil corresponding to said square planar diaphragm, comprising:

four magnetic circuit units which are arranged along the four sides of said square planar diaphragm; and means for mechanically and magnetically coupling said magnetic circuit units to one another at junctions between adjacent ones of said magnetic circuit units, said means for mechanically and magnetically coupling said magnetic circuit units comprising a magnetic coupling member and a mechanical coupling member, said mechanical coupling member being positioned obliquely with respect to end portions of adjacent magnetic circuit units and said magnetic connecting member comprising an elbow-shaped section of magnetic metal.

7. A magnetic circuit for a planar diaphragm type loudspeaker having a square planar diaphragm and a square voice coil corresponding to said square planar diaphragm comprising:

four magnetic circuit units which are arranged along the four sides of said square planar diaphragm; and means for mechanically and magnetically coupling said magnetic circuit units to one another at junctions between adjacent ones of said magnetic circuit units said means for mechanically and magnetically coupling said magnetic circuit units comprises an L-shaped metal member secured to inner walls of adjacent magnetic circuit units by screws, said member having a flange in contact with upper edges of adjacent magnetic circuit units.

8. A magnetic circuit for a planar diaphragm type loudspeaker having a square planar diaphragm and a square voice coil corresponding to said square planar diaphragm, comprising:

four magnetic circuit units which are arranged along the four sides of said square planar diaphragm; and means for mechanically and magnetically coupling said magnetic circuit units to one another at junctions between adjacent ones of said magnetic circuit units, said means for mechanically and magnetically coupling said magnetic circuit units comprises a plate of magnetic metal having first and second perpendicular grooves formed in one surface therof, said grooves being adapted to receive end portions of adjacent magnetic circuit units.

9. A magnetic circuit for a planar diaphragm type loudspeaker having a square planar diaphragm and a square voice coil corresponding to said square planar diaphragm, comprising:

a pair of plates disposed opposite one another;

a plurality of magnets secured to the opposed walls of said plates, magnets of different polarity forming air gaps therebetween, each of said magnets being rectangular in section and having a predetermined length;

a yoke connecting said pair of plates;

said pair of plates, said plurality of magnets and said yoke forming a plurality of magnetic circuit units, said magnetic circuit units being arranged along the four sides of said square planar diaphragm;

means for mechanically and magnetically coupling said magnetic circuit units to one another at junctions between adjacent ones of said magnetic circuit units;

said means for mechanically and magnetically coupling said magnetic circuit units comprising an elbow section of magnetic metal, said elbow section having insert recess portions at both ends thereof and a curved coupling portion therebetween, said insert recess portions being adapted to receive ends of said magnetic circuit units.

10. A magnetic circuit for a planar diaphragm type loudspeaker having a square planar diaphragm and a square voice coil corresponding to said square planar diaphragm, comprising:

a pair of plates disposed opposite one another;

a plurality of magnets secured to the opposed walls of said plates, magnets of different polarity forming air gaps therebetween, each of said magnets being rectangular in section and having a predetermined length;

a yoke connecting said pair of plates;

said pair of plates, said plurality of magnets and said yoke forming a plurality of magnetic circuit units, said magnetic circuit units arranged along the four sides of said square planar diaphragm;

means for mechanically and magnetically coupling said magnetic circuit units to one another at junctions between adjacent ones of said magnetic circuit units;

said means for mechanically and magnetically coupling said magnetic circuit units comprising a magnetic coupling member and a mechanical coupling member, said mechanical coupling member being positioned obliquely with respect to end portions of adjacent magnetic circuit units and said magnetic connecting member comprising an elbow-shaped section of magnetic metal.

11. A magnetic circuit for a planar diaphragm type loudspeaker having a square planar diaphragm and a square voice coil corresponding to said square planar diaphragm comprising:

a pair of plates disposed opposite one another;

a plurality of magnets secured to the opposed walls of said plates, magnets of different polarity forming air gaps therebetween, each of said magnets being rectangular in section and having a predetermined length;

a yoke connecting said pair of plates;

said pair of plates, said plurality of magnets and said yoke forming a plurality of magnetic circuit units, said magnetic circuit units being arranged along the four sides of said square planar diaphragm;

means for mechanically and magnetically coupling said magnetic circuit units to one another at junctions between adjacent ones of said magnetic circuit units;

said means for mechanically and magnetically coupling said magnetic circuit units comprising an L-shaped metal member secured to inner walls of adjacent magnetic circuit units by screws, said member having a flange in contact with upper edges of adjacent magnetic circuit units.

12. A magnetic circuit for a planar diaphragm type loudspeaker having a square planar diaphragm and a square voice coil corresponding to said square planar diaphragm comprising:

a pair of plates disposed opposite one another;

a plurality of magnets secured to the opposed walls of said plates, magnets of different polarity forming air gaps therebetween, each of said magnets being rectangular in section and having a predetermined length;

a yoke connecting said pair of plates;

said pair of plates, said plurality of magnets and said yoke forming a plurality of magnetic circuit units, said magnetic circuit units being arranged along the four sides of said square planar diaphragm;

means for mechanically and magnetically coupling said magnetic circuit units to one another at junctions between adjacent ones of said magnetic circuit units;

said means for mechanically and magnetically coupling said magnetic circuit units comprising a plate of magnetic metal having first and second perpendicular grooves formed in one surface thereof, said grooves being adapted to receive end portions of adjacent magnetic circuit units.

* * * * *